US005370944A

United States Patent [19]

Omori et al.

[11] Patent Number: 5,370,944

[45] Date of Patent: Dec. 6, 1994

[54] DIAMOND-COATED HARD MATERIAL AND A PROCESS FOR THE PRODUCTION THEREOF

[75] Inventors: Naoya Omori; Mitsunori Kobayashi; Toshio Nomura, all of Hyogo, Japan

[73] Assignee: Sumitomo Electric Industries, Ltd., Osaka, Japan

[21] Appl. No.: 30,260

[22] PCT Filed: Jul. 17, 1992

[86] PCT No.: PCT/JP92/00919

§ 371 Date: Apr. 27, 1993

§ 102(e) Date: Apr. 27, 1993

[87] PCT Pub. No.: WO93/02022

PCT Pub. Date: Feb. 4, 1993

[30] Foreign Application Priority Data

Jul. 22, 1991 [JP] Japan ..... 3-205443
Mar. 30, 1992 [JP] Japan ..... 4-74314
Jul. 15, 1992 [JP] Japan ..... 4-187213

[51] Int. Cl.[5] ..... B22F 7/07; B22F 7/06; C23C 16/22

[52] U.S. Cl. ..... 428/565; 428/547; 428/548; 428/551; 428/552

[58] Field of Search ..... 419/38, 40; 428/546, 428/547, 548, 552, 565, 569, 551; 75/228, 230, 235, 238, 242, 244

[56] References Cited

U.S. PATENT DOCUMENTS 4,966,501 10/1990 Nomura et al. ..... 407/119
5,068,148 11/1991 Nakahara et al. ..... 428/335
5,100,703 3/1992 Saijo et al. ..... 427/249
5,181,953 1/1993 Nakano et al. ..... 75/237

*Primary Examiner*—Donald P. Walsh
*Assistant Examiner*—John N. Greaves
*Attorney, Agent, or Firm*—Wenderoth, Lind & Ponack

[57] ABSTRACT

This invention relates to a diamond-coated hard material and a process for the production of the same. The feature of the diamond-coated hard material consists in that in a diamond-coated hard material comprising a substrate of a tungsten carbide-based cemented carbide having a diamond-coated layer provided on the surface of the substrate, a surface-modified layer containing no binder phase or containing a binder phase in a proportion of less than in the interior part of the substrate is present on the outermost surface of the substrate. This hard material can be produced by converting the substrate material into a sintered or heat treated surface or skin and then coating with diamond. The diamond-coated hard material of the present invention has such a high wear resistance and excellent bonding strength to the substrate that it can favorably be applied to various tools, parts, grinding wheels, etc.

16 Claims, 1 Drawing Sheet

DIAMOND-COATED HARD MATERIAL AND A PROCESS FOR THE PRODUCTION THEREOF

TECHNICAL FIELD

This invention relates to a diamond-coated hard material having a very high wear resistance and excellent bonding strength to a substrate and a process for the production of the same, the hard material of the present invention being suitable for use as cutting tools, wear resistant tools, mine tools, electronics parts, mechanical parts, grinding wheels, etc.

BACKGROUND TECHNIQUE

Diamond has many excellent properties, for example, very high hardness, chemical stability, high heat conductivity, high sound wave propagation speed, etc. At the present time, in the market, there have widely and practically been used, as polycrystalline diamond, (1) a polycrystalline diamond sintered compact comprising at least 70 volume % of diamond grains bonded with each other, (2) a diamond-coated hard material comprising a hard material the surface of which is coated with diamond polycrystal and (3) a hard material brazed with diamond polycrystal, for example, (1) cutting tools such as throwaway inserts, drills, microdrills, endmills, routers, etc., which are used for cutting working light metals such as Al, Al—Si alloys, etc., plastics, rubbers, graphite and the like;

(2) rock mining tools;

(3) various wear resistant tools, wear resistant jigs and environment resistant tools such as bonding tools, printer heads, dies, guide rollers for hot working, rolls for making pipes and the like;

(4) various machine parts such as radiating plates;

(5) various vibration plates such as speakers;

(6) various electronic parts; and (7) various grinding or polishing wheels such as electrodeposited grinding wheels and dressers.

The polycrystalline diamond compact obtained by sintering diamond fine powder under ultra-high pressure has been disclosed in, for example, Japanese Patent Publication No. 12126/1977. According to a production process described in this publication, diamond powder is arranged to be in contact with a formed or sintered body of cemented carbide and sintered at a temperature of higher than the liquidus temperature of the cemented carbide under an ultra-high pressure, during which a part of Co in the cemented carbide intrudes into the diamond powder and functions as a binder metal. The thus obtained diamond compact is worked in a desired shape, brazed to various alloys and widely used for, for example, cutting tools, wear resistant tools, digging tools, dressers, wire-drawing dies, etc.

The diamond-coated hard material comprising a hard material the surface of which is coated with polycrystalline diamond has widely been used in the similar manner to the above described diamond compact. As the prior art, there are a number of publications such as Japanese Patent Laid-Open Publication Nos. 57802/1987, 57804/1987, 166904/1987, 14869/1988 and 140084/1988, in which the surface of a hard material with a suitable shape is coated with polycrystalline diamond synthesized from gaseous phase to markedly improve the wear resistance of the substrate. The diamond-coated hard material obtained by this method has a high degree of freedom in shape and a large advanatge such that it can economically be produced in a large amount, and has widely been used as, for example, cutting tools, wear resistant tools, digging tools, dressers, wire-drawing dies, etc.

Furthermore, a diamond coated layer is formed on a surface of a substrate from gaseous phase and the substrate is removed by etching to prepare a plate of polycrystalline diamond, which is worked in a desired shape and brazed to various base metals. The resulting article has been applied to, in addition to the above described uses, various vibrating plates including those of speakers, filters, window materials, etc.

At the present time, there are methods of coating the surface of a substrate with polycrystalline diamond from gaseous phase, for example, microwave plasma CVD method, RF-plasma CVD method, EA-CVD method, induction field microwave plasma CVD method, RF hot plasma CVD method, DC plasma CVD method, DC plasma jet method, filament hot CVD method, combustion method and like. These methods are useful for the production of diamond-coated hard materials.

Of the above described prior art techiques, the various tools obtained by brazing the diamond sintered compact to base metals are restricted in shape. Specifically, it is difficult in the techniques at the present time to braze the diamond sintered compact to all edge parts of, for example, a four-edge end mill with a higher precision. Thus, a round bar of diamond compact must be prepared and subjected to discharge working to obtain a desired shape, so other parts than those really needing a wear resistance are also formed of the diamond compact, resulting in a higher production cost and a lower productivity. This can similarly be said in the case of brazing a polycrystalline diamond plate.

In order to overcome the above described disadvantages, development of a diamod-coated hard material comprising a substrate worked in a desired shape, provided with, on the surface thereof, a diamond-coated layer has widely been carried out. For the diamond-coated hard material, it is first considered to use WC-based cemented carbides excellent in various physical proeprties as a substrate, and when using the WC-based cemented carbides as a substrate, it can sufficiently be expected to provide an article having a higher degree of freedom in shape and higher strength than the diamond compacts and polycrystalline diamond plate-brazed articles in a large amount and in an economical manner. Accordingly, many researchers have made efforts to improve the properties of the diamond-coated hard material, but at the present time, many of the diamond-coated tools are lacking in bonding strength of the diamond-coated layer to a substrate and the diamond-coated layer is stripped to shorten the service life, i.e. not to obtain an equal life to that of the diamond-coated hard material, in many cases. The reason therefor is given below:

1) The thermal expansion coefficients of diamond and a substrate are so different that a residual stress is caused in a diamond-coated layer and the diamond-coated layer tends to be stripped, 2) Diamond having no intermediate phase with all materials shows a low wetting property with other materials and 3) When a substrate contains a metallic element such as Fe, Co, Ni, etc., through which carbon can easily be diffused, like NC-based cemented carbides or cermets, graphite as an allotrope of diamond tends to be preferentially formed on these metallic elements and accordingly, the initial diamond nuclei generating density, during coating diamond, is lowered and the bonding strength between a diamond-coated layer and substrate is lowered, while the wear resistance of the coated layer itself is degraded.

For the purpose of solving the reason (1), there is proposed a method comprising selecting, as a substrate material, a material having the same coefficient of thermal expansion as diamond, for example, a sintered compact consisting predominantly of $Si_3N_4$ or a sintered compact consisting predominantly of SiC, as disclosed in Japanese Patent Laid-Open Publication Nos. 59086/1985 and 291493/1986. Furthermore, it has been proposed to deposit hexagonal pillar or columnar crystals of silicon nitride on the surface of a substrate consisting predominantly of silicon nitride ($Si_3N_4$) to form a roughened state on the surface, providing the roughened surface with a diamond coated layer, and the diamond-coated layer and substrate are rendered geometrically entangled, thus increasing the bonding strength of the diamond-coated layer, as described in Japanese Patent Application No. 269214/1990. According to these proposed methods, the bonding strength between a substrate and diamond-coated layer is markedly increased.

However, in the case of applying the resulting article to, for example, cutting tools and using them under severe conditions, breakage takes place from the substrate because the substrate of $Si_3N_4$ or SiC is lacking in strength and the cutting tools can no longer be used.

As a countermeasure for the reason (2), the surface of a substrate is coated with an intermediate layer and further coated with a diamond-coated layer as described in Japanese Patent Publication No. 7267/1987. When a suitable material is used for the intermediate layer according to this method, the diamond-coated layer and intermediate layer are bonded with a high bonding strength. However, the inventors could not find a material for the intermediate layer, capable of obtaining a sufficient bonding strength simultaneously in the two interfaces between the substrate and intermediate layer and between the intermediate layer and diamond-coated layer, in spite of their studies to examine the bonding strength under severe conditions.

As a countermeasure for the reason (3), there has been proposed a method comprising subjecting the surface of a cemented carbide substrate to etching with an acid solution to remove metallic elements such as Fe or Co as a binder phase, as described in Japanese Patent Laid-Open Publication No. 201475/1989. In the case of carrying out the etching, however, an etched layer is sometimes present on the surbstrate surface to lower the strength of the substrate itself, and the dispersed hard phase tends to scale off or to be broken by the removal of the binder phase, thus resulting in tendency of scaling-off of the diamond-coated layer with the hard phase.

Furthermore, there has been proposed a method comprising subjecting the surface of a substrate to a scratching treatment with diamond grains or a diamond wheel and thereby improving the nuclei forming density of diamond on the surface of the substrate at the initial period of forming a diamond-coated layer, as described in Japanese Patent Laid-Open Publication No. 124573/1986.

In these proposed techniques, however, a sufficient bonding strength between a WC-based cemented carbide and a diamond-coated layer cannot be obtained and it is difficult to obtain a diamond-coated hard material having a sufficient bonding strength as a cutting tool or wear resistant tool. That is, at the present time, no one has succeeded in mass production of a diamond-coated layer having a high bonding strength to a cemented carbide substrate with a low cost.

Under this situation, the present invention aims at providing a diamond-coated hard material having an excellent bonding strength, high toughness and high degree of shaping and a process for the production of the same.

DISCLOSURE OF THE INVENTION

For the purpose of attaining the objects of the present invention, there is provided a diamond-coated hard material comprising a substrate of a tungsten carbide-based cemented carbide containing a hard phase consisting of tungsten carbide or a hard phase consisting of a solid solution of tungsten carbide and at least one of carbides, nitrides or carbonitrides of Group 4B, 5B and 6B elements (exclusive of tungsten) of the Periodic Table, a binder phase and unavoidable impurities, a surface-modified layer formed on the surface of the substrate and a diamond- or diamond-like carbon-coated layer, the surface-modified layer consisting of binder phase-free tungsten and/or tungsten carbide, or a binder phase in a component proportion of less than in the interior part of the substrate and tungsten and/or tungsten carbide.

For example, the diamond-coated hard material of the present invention comprises a substrate of a WC-based cemented carbide and a diamond-coated layer provided on the surface of the substrate, characterized in that a surface-modified layer is present on the outermost surface of the substrate and contains no binder phase or contains a binder phase in a proportion of less than in the interior part of the substrate. Herein, by the surface-modified layer of the present invention is meant a layer having a composition and/or structure different from the interior part of the substrate.

The above described object of the present invention can be attained by a diamond-coated hard material comprising a diamond-coated layer provided on a surface of a substrate, in particular, on a sintered surface of the substrate. In this specification, the surface as sintered will sometimes be referred to as "sintered surface"

The above described object of the present invention can be attained by a diamond-coated hard material comprising a diamond-coated layer provided on a surface of a substrate, in particular, on a heat-treated surface of the substrate. In this specification, the surface as heat treated before grinding will sometimes be referred to as "heat treated surface".

In addition, the present invention provides a diamond-coated hard material comprising a substrate of a WC-based cemented carbide and a diamond-coated layer provided on the surface of the substrate, characterized in that a surface-modified layer is present on the outermost surface of the substrate and contains no binder phase or contains a binder phase in a proportion of less than in the interior part of the substrate, a hard phase of the surface-modified layer being composed of (1) WC and/or (2) at least one solid solution of WC and at least one of carbides, nitrides, carbonitrides, oxides, borides, borocarbides, boronitrides and borocarbonitrides of Group 4B, 5B and 6B elements (exclusive of W) of Periodic Table and/or (3) at least one of the carbides, nitrides, carbonitrides, oxides, borides, borocarbides and borocarbonitrides of Group 4B, 5B and 6B elements (exclusive of W) of the Periodic Table or at least one solid solution of at least two of these compounds.

The diamond-coated hard material of the present invention can be produced by, for example, a process comprising sintering a substrate of a cemented carbide in an atmosphere at a partial pressure of $N_2$ and/or CO of at least 1 Torr, using at least a part of the surface of the resulting sintered compact as a sintered surface and providing a diamond-coated layer on at least a part of the surface of the sintered surface, or a process comprising sintering a substrate of a cemented carbide, working it into an object shape, then subjecting to a heat treatment in an atmosphere at a partial pressure of $N_2$ and/or CO of at least 1 Torr at a temperature of 900° to 1500° C. for 10 minutes to 5 hours, using at least a part of the surface of the substrate as a heat treated surface, and providing a diamond-coated layer on at least a part of the surface of the heat treated surface. These steps or processes can be carried out in continuous manner.

BEST EMBODIMENT FOR PRACTICING THE INVENTION

Figure 1:
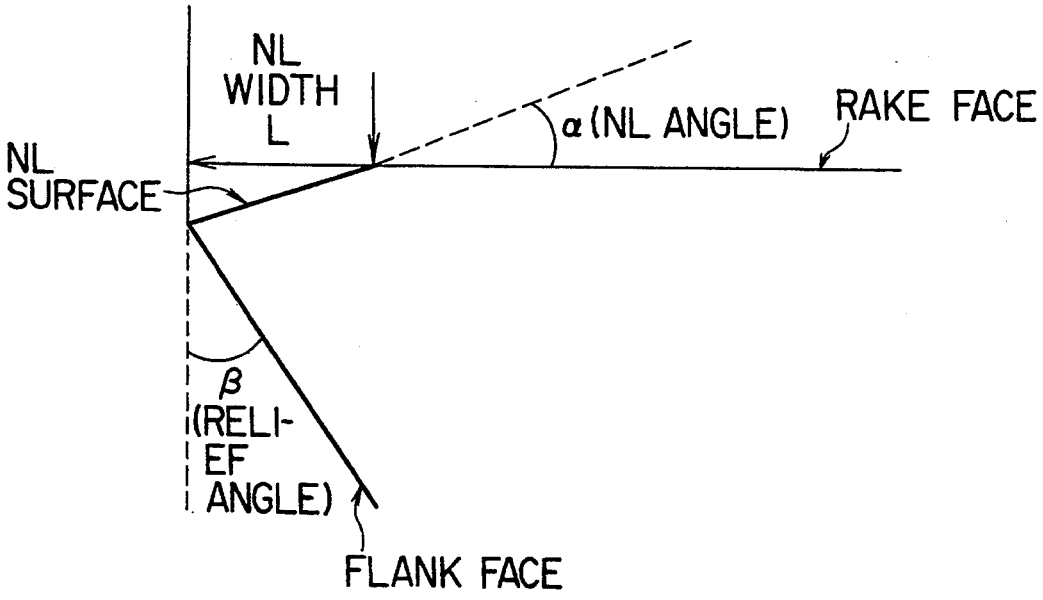
FIG. 1 is a schematic view for illustrating an edge treatment of an insert used in Example 1 of the present invention.

Generally, it is well known that diamond shows a high nuclei-forming density on WC, metallic W, carbides, nitrides, carbonitrides, oxides, borides, borocarbides and borocarbonitrides of Group 4B, 5B and 6B elements including Ti (exclusive of W) of Periodic Table or solid solutions thereof, and thus a high bonding strength thereto. Moreover, diamond has a coefficient of linear expansion nearer to that of W or WC than cemented carbides and accordingly a higher bonding strength to these materials. However, binder phase-free WC does not have a good sintering property and must be worked by a hot press method, resulting in a low degree of shaping and a high production cost. A substrate of WC produced in this way has a low toughness and meets with a same problem as in the case of using silicon nitride or silicon carbide as a substrate. When using W as a substrate, the strength thereof is often insufficient.

Accordingly, a WC-based cemented carbide is used as a substrate in the present invention and a layer having a different composition and/or structure (which will hereinafter be referred to as a surface-modified layer) from the interior part of the substrate is allowed to be present on the surface of the substrate, the surface-modified layer having no binder phase or having a binder phase in a proportion of less than in the interior part of the substrate, preferably less than 1 weight %, more preferably less than 0.5 weight %. A diamond-coated layer having a high bonding strength can be formed on the surface-modified layer and at the same time, the high strength that WC-based cemented carbides intrinsically have can be expected as a substrate strength. Since the surface-modified layer is formed in one body with the substrate, furthermore, such problems do not arise that the intermediate layer is scaling off and that the strength of the substrate is lowered when the binder phase around the hard phase is removed by etching and the strength is lowered by formation of an etched layer.

Typical compositions of cemented carbides for the substrate of the present invention are given below:

(1) A WC-based cemented carbide comprising 0.5 to 30 weight % of Co as a binder phase component and WC and unavoidable impurities as a hard dispersed phase-forming component.

(2) A WC-based cemented carbide comprising 0.5 to 30 weight % of Co as a binder phase component and a solid solution of (a) WC and (b) at least one of Group 4B, 5B and 6B elements of Periodic Table exclusive of the W, or carbides, nitrides, carbonitrides, oxides, borides, borocarbides, boronitrides and borocarbonitrides of these elements and unavoidable impurities, as a hard dispersed phase-forming component.

(3) A WC-based cemented carbide comprising 0.5 to 30 weight % of Co as a binder phase component and a solid solution of (a) WC and (b) at least one of Group 4B, 5B and 6B elements of Periodic Table exclusive of the W, or carbides, nitrides, carbonitrides, oxides, borides, borocarbides, boronitrides and borocarbonitrides of these elements and (c) WC and unavoidable impurities, as a hard dispersed phase-forming component.

(4) A WC-based cemented carbide comprising 0.5 to 30 weight % of Co as a binder phase component and a solid solution of (a) WC and (b) at least one of Group 4B, 5B and 6B elements of Periodic Table exclusive of W, or carbides, nitrides, carbonitrides, oxides, borides, borocarbides, boronitrides and borocarbonitrides of these elements and (c) WC and/or (d) a solid solution of WC and at least one of Group 4B, 5B and 6B elements of Periodic Table exclusive of the W, or carbides, nitrides, carbonitrides, oxides, borides, borocarbides, boronitrides and borocarbonitrides of these elements, and unavoidable impurities, as a hard dispersed phase-forming component [exclusive of those which overlap with (3)].

The above described composition is represented by a general range and in particular, the significant point is that the hard dispersed phase and binder phase are well balanced in this range to maintain a high substrate strength.

When the above described WC-based cemented carbide further contains, as a hard phase, at least one of carbides, nitrides or carbonitrides of at least one of Group 4B, 5B and 6B elements of Periodic Table exclusive of the W, the high temperature hardness of the substrate is increased due to presence of these carbides, nitrides or carbonitrides in a proportion of preferably 0.2 to 40 weight %, since if less than 0.2 weight %, the effect thereof is little, while if more than 40 weight %, the strength of the substrate is lowered.

The surface-modified layer of the present invention comprises, for example, (i) no binder phase or a binder phase in a proportion of less than in the interior part of the substrate and a hard phase consisting of WC and/or WC and at least one of carbides, nitrides, carbonitrides, oxides, borides, borocarbides, boronitrides or borocarbonitrides of Group 4B, 5B and 6B of elements of the Periodic Table exclusive of W, or (ii) no binder phase or a binder phase in a proportion of less than in the interior part of the substrate and a hard phase consisting of at least one of carbides, nitrides, carbonitrides, oxides, borides, borocarbides, boronitrides or borocarbonitrides of Group 4B, 5B and 6B elements of the Periodic Table exclusive of W.

(iii) The further feature thereof consists in that on the surface of the substrate, the composition proportion of (1) a solid solution of WC and at least one of carbides, nitrides, carbonitrides, oxides, borides, borocarbides, boronitrides or borocarbonitrides of Group 4B, 5B and 6B elements of the Periodic Table exclusive of W, and/or (2) a solid solution of at least one of carbides, nitrides, carbonitrides, oxides, borides, borocarbides, boronitrides or borocarbonitrides of Group 4B, 5B and 6B elements of the Periodic Table exclusive of W is higher than in the interior part.

As illustrated above, it is required that the surface-modified layer of the present invention is a material excellent in bonding property to diamond and is formed in one body with the substrate on the surface of the WC-based cemented carbide substrate.

Examples of the method for forming the state of this surface-modified layer are as follows:

(Method A): When raw materials of the WC-based cemented carbide substrate are mixed, shaped, sintered and cooled, the sintering and/or cooling is carried out in an atmosphere having a higher partial pressure than the equilibrium partial pressure of $O_2$ and/or $N_2$ of the hard phase as described above. The $O_2$ partial pressure can be adjusted to about the desired partial pressure by the use of a CO gas atmosphere.

(Method B): The surface-modified layer can also be formed by subjecting again a substrate, once having arbitrarily been sintered and ground, to a heat treatment under the above described condition to convert the surface state of the substrate into a state near the sintered surface. In the present invention, the thus resulting substrate surface is called "heat treated surface".

(Method C): A slurry having a composition corresponding to the surface-modified layer comprising only a hard phase or enriched in the hard phase and a slurry having a Composition corresponding to the substrate containing a predetermined binder phase are in order injected in a mold and the resulting molding is sintered.

(Method D): A powder having a composition corresponding to the surface-modified layer comprising only a hard phase or enriched in the hard phase and a powder having a composition corresponding to the substrate containing a predetermined binder phase are in order filled in a mold, pressed and the resulting molding is sintered.

(Method E): A powder having a composition corresponding to the surface-modified layer comprising only a hard phase or enriched in the hard phase and a powder having a composition corresponding to the substrate containing a predetermined binder phase are individually molded and presintered, and the resulting presintered products are laminated and sintered under pressed state.

(Method F): When sintering a molding consisting of a composition corresponding to the substrate containing a predetermined binder phase, the sintering is carried out while blowing tungsten powder and/or tungsten carbide powder against the surface of the molding.

In the above described methods B to F, the sintering is carried out at a low temperature using a pressure furnace in order to control movement of the binder phase to as little as possible.

In the method A, the sintering temperature and time can be those commonly used for sintering cemented carbides. Specifically, the sintering is carried out at a temperature of 1300° to 1500° C. for 30 minutes to 3 hours. The foregoing gaseous atmosphere of $O_2$ and/or $N_2$ can be maintained from any step of the initial period of sintering, intermediate period of sintering and cooling step, but unless a temperature range of 900° to 1500° C. is maintained for at least 10 minutes, the movement of the hard phase to the interface is not sufficient and formation of the surface-modified layer is not found. In the present invention, the thus resulting substrate surface is called "sintered surface".

The heat treating condition in the method B of the present invention is similar to that of the sintering condition and is generally a temperature range of 1300° to 1500° C. for a period of 30 minutes to 3 hours. Maintaining an atmosphere having a higher partial pressure than the equilibrium partial pressure of $O_2$ and/or $N_2$ of the hard phase from any step of the initial period of sintering, intermediate period of sintering and cooling step, but unless a temperature range of 900° to 1500° C. is maintained for at least 10 minutes, the movement of the hard phase to the interface is not sufficient and formation of the surface-modified layer is not found. This is not preferable. When the heat treatment is carried out for a long time, e.g. exceeding 1000 minutes, the hard phase grains of the substrate cemented carbide are coarsened to deteriorate the strength, which should be avoided.

Furthermore, when the surface states and cross sections of the sintered surface and heat treated surface respectively obtained in the methods A and B were observed, it was found that the surface roughness was deteriorated. Accordingly, it is assumed that the physical bonding force between the diamond-coated layer and substrate are increased to improve the bonding strength between the diamond-coated layer and substrate.

The surface roughness herein specified includes not only that measured by a needle touch meter, but also that in a micro interval. By the surface roughness in a micro interval is meant a surface roughness in the standard length, for example, in such a micro interval that the standard length is 50 μm in the interface of the diamond-coated layer-substrate outermost surface. Calculation of the surface roughness of the coated substrate is effected by a boundary line of the diamond-coated layer-substrate defined by lapping and observing the cross section of the substrate after coating diamond and photographing. In this case, Rmax* is defined by a difference between the maximum height of the boundary line in the standard length and the minimum height thereof, while regarding a macroscopic undulation as linear.

When the above described sintered surface or skin and heat treated surface or skin are formed, it is sometimes found that the binder phase oozes on the surface, depending upon the carbon content in the sintered compact or the sintering method. Since a diamond coated layer formed on the surface of the oozed binder phase readily scales off, it is necessary to remove the oozed binder phase. As a method of removing the oozed binder phase, there are etching, blasting, barreling and the like. In the mechanical working such as blasting, barreling, etc., the surface smoothness is improved to lower the effect of improving the bonding strength due to deterioration of the surface roughness and accordingly, the etching method is preferable. The etching herein defined is carried out for the purpose of removing the oozed binder phase, not etching the substrate as described above in Background Technique. Therefore, when the surface-modified layer contains no binder phase, there is no etched layer on the substrate, and even when there is the binder phase, the etching is only carried out to such an extent that deterioration of the substrate strength does not take place because of the small amount of the binder phase. The removal treatment of the oozed binder phase can similarly be carried out to the heat treated surface.

In order to improve the diamond nuclei-forming density at the initial period of forming the diamond-coated layer, in general, some scratching treatment has widely been carried out. In the present invention, it is also preferable to subject a substrate before forming the diamond-coated layer to a scratching treatment. However, a scratching treatment using a diamond wheel or by physically pressing diamond grains to a substrate tends to remove the surface-modified layer once formed or to lower the microscopic surface roughness, so that the bonding strength between the diamond-coated layer and substrate be lowered. Thus, in order to avoid this phenomenon, a scratching treatment utilizing ultrasonic wave vibration, having generally been carried out, is preferable. Specifically, this method comprises adding the substrate before forming the diamond-coated layer and hard grains such as diamond grains or BN grains to a solvent such as water, alcohols, etc. and then applying ultrasonic wave vibration thereto, whereby the hard grains are brought into collision with the substrate. When using this method, scratching of the surface of the substrate can be carried out without changing the macroscopic surface roughness Rmax, Ra and Rz (according to JIS B 0601) or microscopic surface roughness Rmax* of the substrate surface and the composition proportion of elements composing the surface.

In the present invention, the material for the cemented carbide as a substrate can be the WC-based cemented carbides having the above described compositions (1) to (4) and it is found, as a result of many tests, that in Methods A and B, the compositions (3) and (4) including solid solutions of at least two of carbides, nitrides, carbonitrides, oxides, borides, borocarbides, boronitrides or borocarbonitrides of Group 4B, 5B and 6B elements of the Periodic Table exclusive of W, including WC, are preferable as a hard phase component.

The reason therefor can be considered as follows. In view of the coefficient of linear expansion, it is desirable that a hard phase consisting of WC and/or W is present on the surface of the substrate, but in view of the chemical bonding with a diamond-coated layer, it is preferable to select "a solid solution of WC and at least one of carbides, nitrides, carbonitrides, oxides, borides, borocarbides, boronitrides or borocarbonitrides of Group 4B, 5B and 6B elements of the Periodic Table exclusive of W". Thus, the inventors have made studies to find out the best composition of a substrate for satisfying the opposite requirements, described above, i.e. two effects of preference of the coefficient of linear expansion and preference of the chemical bonding and consequently, have found that increasing the chemical bonding force results in a higher bonding strength to the diamond-coated layer even at the sacrifice of the effect of improving the bonding strength relating to the coefficient of linear expansion to some extent.

Furthermore, it is found that when the grain diameters of various hard phases composing the cemented carbides are at least 1 μm, a good diamond-coated layer with an excellent bonding strength can be obtained. The reason therefor has not become yet, but it is assumed that when this condition is satisfied, physical compatibility of the diamond-coated layer with the substrate is best. However, it is not clear whether this assumption is correct or not.

In the present invention, the distribution of binder phase proportions in the surface-modified layer is varied with the sintering conditions and heat treatment conditions and can be reduced continuously or intermittently.

In the case of sintering a substrate or heat-treating a substrate after grinding working according to Mehtod A or Method B, enhancement of the strength can be expected by reducing the deterioration of the strength due to coarsening of the crystalline grains to as little as possible and reducing defects (pores) in the interior part of the substrate. During the same time, it is desirable to effect a hot hydrostatic press compression at a temperature of lower than the sintering temperature, preferably 1200° to 1450° C., more preferably 1300° to 1350° C. More excellent effects can be expected when the hydrostatic pressure is higher and a pressure of 10 to 3000 atm is preferable from a commercial point of view.

In the production of the diamond-coated hard material of the present invention as illustrated above, when the step of sintering and/or heat treatment and the step of forming a diamond-coated layer are carried out in a same container or two or more containers, at least a part of which is continued, in continuous manner, the production cost can be reduced on a commercial scale. In Methods C, D, E and F, the sintering is preferably carried out at a low temperature using a pressure furnace so as to decrease movement of the binder phase toward the substrate surface as far as possible.

As to the thickness of the surface-modified layer, if less than 0.01 μm, the influence of the hard phase components in the substrate is strengthened and the presence of the surface-modified layer does not serve to improve the bonding strength. In order to completely cut off this influence, the thickness should be at least 0.1 μm, preferably at least 0.5 μm. As to the upper limit, a thickness of at most 200 μm is preferable to maintain a desired substrate strength.

When the surface roughness of the substrate prepared by Method A or B of the present invention is at least 1.5 μm by Rmax, measured by the needle touch method, according to JIS Standard, the bonding strength is largely improved. It is further confirmed that the bonding strength is largely improved when the microscopic surface roughness by the foregoing observation of the cross section is at least 2 μm by Rmax*.

In the diamond-coated hard material of the present invention, it is found that the hardness of the surface part of the substrate is higher than that of the interior part. Specifically, when the cross section of the substrate is lapped and subjected to measurement of the Vickers hardness thereof by a load of 500 g, it is found that the surface part of the substrate is higher by at least 5%. Furthermore, it is found as a result of our further studies that the diamond-coated layer on a substrate having a larger hardness by at least 10% exhibits a more excellent bonding strength.

In the diamond-coated hard material of the present invention, it is further found in measurement of the diffraction curve by Cu-Kα line from the surface thereof that when the diffraction intensity ratio of (101) plane of tungsten carbide and that of (200) plane of a solid solution of B1 type of at least one of carbides, nitrides, carbonitrides, oxides, borides, borocarbides, boronitrides and borocarbonitrides of Group 4B, 5B and 6B of the Periodic Table are compared, the former is smaller. Further studies teach that when a value A is defined by:

$$\frac{\text{[Diffraction Intensity Ratio of (101) Plane of Tungsten Carbide]}}{\text{[Diffraction Intensity Ratio of (101) } B1 \text{ Type Solid Solution]}} = A$$

the smaller A is, the more excellent is the bonding strength of the diamond-coated layer, and A is preferably at most 0.5, more preferably at most 0.1.

Furthermore, it is found that the residual stress present in the WC phase on the surface in the diamond-coated hard material of the present invention is sometimes smaller as compared with the residual stress present on the ground surface of the ordinary WC-based cemented carbide compact, i.e. 0.7 to 1.6 GPa.

Furthermore, it is found that the lattice constant of a solid solution of B1 type having a crystalline structure of face-centered cubic lattice, composed of at least one of carbides, nitrides, carbonitrides, oxides, borides, borocarbides, boronitrides and borocarbonitrides of Group 4B, 5B and 6B of the Periodic Table and solid solutions thereof, present in the substrate interlayer of the diamond-coated hard material of the present invention, is sometimes smaller as compared with that of the WC-based cemented carbide substrate finished by grinding.

The diamond-coated layer of the present invention can be formed of either diamond or diamond-like carbon, or of composite layers thereof, and can contain boron, nitrogen, hydrogen, etc. Formation of the diamond-coated layer of the present invention can be carried out by any known methods such as CVD methods.

Thickness of the diamond-coated layer can be adjusted to a necessary one depending upon the use thereof. However, for a use needing a wear resistance, the layer thickness should be 0.5 to 300 μm, since if less than 0.5 μm, no improvement of various properties such as wear resistant by the coated layer is found, while if more than 300μm, further improvement of the various properties can no longer be given and this is not economical.

The foregoing illustration is conducted as to a case where diamond is coated, but the present invention can be applied with similar benefits to cases where diamond-like carbon is coated and a composite layer of diamond and diamond-like carbon is formed. These layers can contain boron or gaseous elements such as $N_2$. The coating of diamond can be carried out by any of known methods, as illustrated in the Background Technique.

Even if the surface of the diamond-coated layer is smoothened or rendered mirror-wise by a diamond wheel or heat treatment to obtain a predetermined surface roughness and/or dimensional precision, the bonding property to the substrate of the present invention is maintained excellent. When the present invention is applied to cutting tools or wear resistance tools, for example, the smoothened surface roughness of the diamond-coated layer, as a working surface, results in reduction of the cutting resistance, improvement of the surface roughness of a working surface, improvement of the sliding property, improvement of the welding resistance of a workpiece or material to be cut, etc. In particular, when the smoothening is carried out to an extent of at most 0.5 μm by Rmax defined according to JI8 B 0601, the effect is larger.

The following examples are given in order to illustrate the present invention in detail.

[EXAMPLE 1]

A throwaway insert formed of a WC-based cemented carbide with a shape of SEGN 422 (inscribed circle: 12.7 mm; thickness: 3.18 mm; corner R: 0.8 mm; angle of relief: 20°), described in JIS B 4103, was prepared by pulverizing powdered raw materials having compositions shown in Table 1 by the use of a vibrating mill, adding a binder thereto, subjecting the mixture to press molding and molding working, removing the binder at 300° C. and sintering the mixture under each of conditions shown in Table 2. If necessary, a treatment for the removal of the binder phase was carried out.

TABLE 1

| | Composition of substrate (weight %) |
|---|---|
| a | WC - 4% Co |
| b | WC - 5% Co - 0.4% TaC - 0.2% NbC |
| c | WC - 5.5% Co - 9% TiC - 10% TaC - 5% NbC |
| d | WC - 11% Co - 10% TiC - 12% TaC |
| e | WC - 0.5% VC - 11% Co |

TABLE 2

| Condition | Temperature (°C.) | Time (min) | Ambient Gas | |
|---|---|---|---|---|
| i | 1400 | | Co gas | 80 Torr |
| ii | 1400 | | $N_2$ gas | 10 Torr |
| iii | 1400 | | $N_2$ gas | 200 Torr |
| iv | 1400 | | $N_2$ gas | 100 Torr |
| v | 1400 | 90 | $N_2$ gas | 1000 Torr |
| vi | 800 | | | |
| vii | 1000 | | | |
| viii | 1200 | | | |
| ix | 1300 | | $N_2$ gas | 200 Torr |
| x | 1400 | 1 | | |
| xi | 1400 | 10 | | |
| xii | 1400 | 1000 | | |
| xiii | 1400 | 90 | $N_2$ gas | $10^{-2}$ Torr |

For comparison of the ground surface or skin and sintered surface or skin, each of the substrate inserts was worked by a method shown in Table 3. An example of an edge treatment of the insert was shown in FIG. 1, in which the edge treatment, generally called chamfer honing working, was carried out with $\alpha=25°$, $\beta=20°$ and L=0.05 mm. For working the edge treatment surface, grinding working the upper and lower surfaces and grinding working the side surfaces was used a commercially available resin-bonded diamond wheel.

TABLE 3

| Working No. | Summary of Working Method |
|---|---|
| I | providing insert with wholly sintered surface |
| II | subjecting to edge treatment shown in FIG. 1 and providing other part with sintered surface |
| III | subjecting upper and lower surfaces of insert to only grinding working and providing other part with sintered surface |
| IV | subjecting side surfaces of insert to only grinding working and providing other part with sintered surface |
| V | subjecting upper and lower surfaces of insert to grinding working and edge treatment shown in FIG. 1 and providing side surfaces with sintered surfaces |
| VI | subjecting side surfaces to grinding working and edge treatment shown in FIG. 1 and providing upper and lower surfaces with sintered surfaces. |
| VII | subjecting side surfaces and upper and lower surfaces to grinding working (wholly ground surface) |

TABLE 3-continued

| Working No. | Summary of Working Method |
|---|---|
| VIII | subjecting side surfaces and upper and lower surfaces to grinding working and to edge treatment (wholly ground surface) |

In Table 4 are shown the substrate materials of the thus prepared inserts, the sintering conditions, the surface roughness Rmax or Rmax* before forming the diamond-coated layer, the methods of removing the binder phase and the methods of working the inserts.

These prepared inserts were immersed in a solution in which diamond grinding grains with a grain diameter of 8 to 16 μm were purely floated and dispering, and to which an ultrasonic wave vibration of 45 kHz was applied for 5 minutes, to effect a scratching treatment. A diamond-coated layer was then formed by the known hot filament CVD method under the following conditions to prepare the diamond-coated throwaway inserts 1) to 23) according to the present invention.

| | |
|---|---|
| Reaction Tube: | quartz 200 mm |
| Filament Material: | W |
| Filament Temperature: | 2100° C. |
| Surface Temperature of Insert: | 850° C. |
| Ambient Gas: | hydrogen-methane 2%, 80 Torr |
| Coating Time: | 1-12 hours |

The thickness of a diamond-coated layer of each of the inserts is also shown in Table 4.

In Table 4, the microscopic surface roughness means a surface roughness in such a micro interval that the standard length is 50 μm in the interface of the substrate-diamond-coated layer. Calculation of the surface roughness of the coated substrate is effected by a boundary line of the diamond-coated layer-substrate defined by lapping and observing the cross section of the insert. In this case, Rmax* is defined by a difference between the maximum height and the minimum height in the standard length. Rmax is measured by the needle touch method according to JIS B 0601. The layer thickness of the surface-modified layer of the sintered surface is also measured by the observation of the cross section to obtain results shown in Table 4.

Furthermore, each of Insert Samples No. 1 to No. 20 whose cross sections had been observed was subjected to measurement of the Vickers hardness of the surface part and interior part of the substrate using a load of 200 g. Thus, it was confirmed that the hardness of the surface part was improved by 5 to 15% except Insert Sample No. 9 as Comparative Example. When the diffraction curve, as to the surface of the sintered surface, having a diamond-coated layer formed, was measured by Cu-Kα line, in addition, it was confirmed that the foregoing Value A was in the range of 0.05 to 1.0% for the substrate compositions c, d and e. For example, Insert Sample No. 7 of the present invention had a Value A of 0.07. When Insert Sample No. 21 was subjected to the similar examination for comparison, it was confirmed that the hardness of the surface part did not rise and Value A was 2.0.

Furthermore, when the surface of Insert Sample No. 21 before coating a diamond-coated layer, i.e. the substrate surface having a substrate composition c and subjected to grinding, was further subjected to measurement of the residual stress of the WC phase and the lattic constant of the B1 type solid solution having a crystalline structure of face-centered cubic lattice, composed of at least one of carbides, nitrides, carbonitrides, oxides, borides, borocarbides, boronitrides and borocarbonitrides of Group 4B, 5B and 6B of the Periodic Table exclusive of W and solid solutions thereof, by the known X-ray diffraction method, they were respectively 1.5 GPa and 4.365 Å. In contrast, Insert Sample No. 7 of the present invention was subjected to measurement of the same physical values to obtain at most 0.1 GPa and 4.360 Å.

In this Example, it was found by Raman spectroscopic analysis that there was present a peak at 1333 $cm^{-1}$ characteristic of diamond in the coated layer deposited on the surface of the substrate.

For comparison, on the other hand, comparative samples were prepared, that is, cemented carbide inserts each having a substrate composition of a, b or c shown in Table 1 and the same shape (Comparative Insert Samples A, B and C); a polycrystalline diamond insert having the same shape, prepared by coating the surface of a Si substrate under the same conditions as in the above described hot filament CVD method for 200 hours, etching and removing the substrate with an acid to obtain a polycrystalline diamond plate having a thickness of 0.3 mm, substantially free from a binder phase, brazing the resulting diamond plate to a base of cemented carbide having a composition of b shown in Table 1 and then subjecting the brazed product to grinding (Comparative Insert Sample D); a diamond sintered insert having the same shape, prepared by brazing a commercially available diamond compact containing 10 volume % of a binder phase to a cemented carbide having a composition of b shown in Table 1 and then subjecting the brazed product to grinding (Comparative Insert Sample E); and a diamond-coated insert of a silicon nitride ceramic substrate, prepared by using an insert having the same shape and a composition of $Si_3N_4$—$3Al_2O_3$—$5ZrO_2$ (overall ground surface, subjected to edge treatment as shown in FIG. 1), mainatining the insert at 1800° C. and 5 atm for 1 hour to deposit, on the surface thereof, a columnar or pillar crystal of $Si_3N_4$ freely grown in a size of a major axis of 8 μm and a minor axis of 1.5 μm, scratching the thus resulting substrate in a similar manner to that described above and then forming a diamond-coated layer thereon (Comparative Insert Sample F). Comparative Insert Samples A to E each were not subjected to an edge treatment.

Using these cutting inserts, cutting tests were carried out under the following two conditions:

| (Continuous Cutting Test by Lathe-Examination of Wear Resistance) | |
|---|---|
| Workpiece to be cut: | Al-18 wt % Si alloy (round bar) |
| Cutting Speed: | 1000 m/min |
| Feed: | 0.2 mm/rev |
| Cutting Depth: | 1.0 mm |
| Cutting Oil: | water-soluble |
| Cutting Time: | 15 minutes |
| (Intermittent Cutting Test by Milling-Examination of Edge Strength) | |
| Workpiece to be cut: | Al-18 wt % Si alloy (block material) |
| Cutting Speed: | 1000 m/min |
| Feed: | 0.4 mm/rev |
| Cutting Depth: | 2.0 mm |
| Cutting Oil: | water-soluble |
| Cutting Time: | 1 minutes |

In the continuous cutting test, the flank wear width and the wear state of the edge were observed and in the intermittent cutting test, sixteen corners were cut and the number of broken edges were counted. The results are shown in Table 4.

TABLE 4

| Insert Sample No. | Substrate Material | Sintering Conditions | Surface-Modified Layer Thickness (μm) | Sintered Surface Roughness[5] Rmax | Sintered Surface Roughness[5] Rmax* | Removal of Binder Phase[2] | Working of Insert | Thickness of Diamond-coated Layer[3] (μm) | Results of Continuous Cutting Test: Cutting Edge State | Results of Continuous Cutting Test: Flank Wear Width (mm) | Results of Intermittent Cutting Test[4] |
|---|---|---|---|---|---|---|---|---|---|---|---|
| 1 | a | i | 2.0 | 1.7 | 2.1 | — | I | 5.2 | normal wear | 0.16 | 1 |
| 2 | a | iii | 1.5 | 1.5 | 2.1 | — | I | 5.0 | normal wear | 0.15 | 2 |
| 3 | b | i | 4.5 | 1.6 | 2.2 | — | I | 4.8 | normal wear | 0.14 | 2 |
| 4 | b | iii | 2.5 | 1.7 | 2.6 | — | I | 4.7 | normal wear | 0.15 | 1 |
| 5 | c | i | 10.0 | 1.8 | 2.4 | — | I | 5.2 | normal wear | 0.09 | 1 |
| 6 | c | ii | 3.0 | 4.5 | 5.7 | *1 | I | 5.4 | normal wear | 0.08 | 2 |
| 7 | c | iii | 3.5 | 6.2 | 8.9 | — | I | 5.1 | normal wear | 0.07 | 2 |
| 8 | c | ix | 1.3 | 1.5 | 4.5 | — | I | 5.1 | normal wear | 0.07 | 3 |
| 9*[1] | c | xiii | 3.0 | 1.3 | 1.5 | *2 | I | 4.5 | At cutting for 2 min flank wear width exceeded 0.3 mm. | | 7 |
| 10 | d | i | 15.5 | 2.2 | 2.8 | *2 | I | 5.3 | normal wear | 0.12 | 4 |
| 11 | d | iii | 3.8 | 5.5 | 7.2 | *2 | I | 5.1 | normal wear | 0.11 | 3 |
| 12 | e | i | 4.0 | 2.0 | 2.2 | *2 | I | 4.7 | normal wear | 0.18 | 3 |
| 13 | e | iii | 2.4 | 1.5 | 1.8 | *2 | I | 5.0 | normal wear | 0.16 | 5 |
| 14 | c | iii | 3.5 | 6.2 | 8.9 | — | II | 5.2 | (A) | 0.14 | 2 |
| 15 | c | iii | 3.5 | 6.2 | 8.9 | — | III | 4.7 | (B) | 0.16 | 2 |
| 16 | c | iii | 3.5 | 6.2 | 8.9 | — | IV | 4.6 | (C) | 0.22 | 3 |
| 17 | c | iii | 3.5 | 6.2 | 8.9 | — | V | 5.3 | (D) | 0.18 | 2 |
| 18 | c | iii | 3.5 | 6.2 | 8.9 | — | VI | 5.0 | (E) | 0.24 | 3 |
| 19 | c | iii | 3.5 | 3.2 | 5.9 | — | I | 12.5 | normal wear | 0.06 | 1 |
| 20* | c | iii | 3.5 | 3.2 | 5.9 | — | I | 0.5 | normal wear | 0.41 | 2 |
| 21* | a | iii | 1.5 | 1.5 | 2.1 | — | VII | 4.6 | | | 3 |
| 22* | b | iii | 2.5 | 1.7 | 2.6 | — | VIII | 5.1 | (F) | | 1 |
| 23* | c | iii | 3.5 | 6.2 | 8.9 | — | VII | 3.7 | | | 3 |
| A | a | iii | | | | | VIII | | | | 2 |
| B | b | iii | | | | | VII | — | (G) | | 3 |
| C | c | iii | | | | | VIII | | | | 1 |
| D | | | | | | | VII | — | (H) | 0.09 | 13 |
| E | | | | | | | VII | — | (H) | 0.13 | 10 |
| F | | | | | | | VIII | 8.0 | normal wear | 0.09 | 16 |

Note:
Cutting Edge State
(A): fine peeling on NL face; (B): fine peeling on rake face; (C): fine peeling on flank face; (D): fine peeling on rake face and NL face; (E): fine peeling on flank face and NL face; (F): At cutting for 3 minutes, flank wear width exceeded 0.3 mm and diamond-coated layer was largely peeled off. (G): At cutting for 2 minutes, flank wear width exceeded 0.3 mm. (H): normal wearing · fine peeling In Table 4, note marks have the following meanings:

1) On the surface of Sample No. 9* is present a layer having a different composition from that of the interior part, but the binder phase contained therein is enriched as compared with that in the interior part. Thus, this layer is different from the surface-modified layer defined by the present invention (Comparative Example).

2) Method of Removing Binder Phase

* 1: Washing with 5% nitric acid at 30° C. to remove Co oozed on the surface. Observation of the cross section tells that the surface is uniformly covered by a surface-modified phase formed of a hard phase under the oozed Co and no etched phase is thus present in the interior part of the substrate.
* 2: Removal of the binder phase under the same conditions as those of 1*. The binder phase oozed on the surface is removed, but the binder phase present in the surface-modified layer is also etched.

3) The layer thickness of the diamond-coated layer is a mean layer thickness in the vicinity of the edge of the insert.

4) The results of the intermittent cutting test tell that when Comparative Insert Samples D and E were subjected to an edge treatment of FIG. 1 and repeatedly to the intermittent cutting test, the number of broken edges were decreased respectively to eight and ten corners.

5) As to the surface roughness, Rmax and Rmax* of the ground surface were 1.0 μm.

It will clearly be understood from the results of Table 4 that in the insert of the present invention, in particular, the diamond-coated layer on the sintered surface is excellent in bonding strength. Furthermore, it is apparent that the insert of the present invention using a tough cemented carbide as a substrate has a higher toughness as compared with brazed tools of diamond compacts or polycrystalline diamond plates. In the cemented carbide inserts provided with no diamond-coated layer (Comparative Insert Samples A to C), a workpiece tends to be deposited on the edge end to form a built-up wedge, so that the cutting resistance is increased to enlarge the tendency of breakage, while in the insert of the present invention, this tendency can largely be reduced. Accordingly, when using a substrate having a higher content of a binder phase, it is often required to remove the binder phase and the strength of the substrate is thus lowered in some cases. However, the degree of lowering of the strength is not so large and the strength of the cemented carbide is not so deteriorated. It is apparent from the results of this Example and Comparative Example that the inserts each using a compound of c having relatively large amounts of TiC and TaC generally give better results.

[EXAMPLE 2]

In this Example, the sintered surface and heat treated surface were compared. Mixed powders of various compositions as shown in Table 1 were prepared for a substrate, mixed, molded (but not affecting the treatment of removing the binder at 300° C.), sintered under the condition xiii shown in Table 2 and subjected to working shown in Table 3 to prepare substrate inserts each having the same shape as Example 1. These samples were heat treated under the conditions shown in Table 2 to convert the insert surfaces to heat treated surfaces. These inserts were further subjected to working as shown in Table 5 to prepare substrate inserts of the present invention, a partial surface or whole surface of which is a heat-treated surface.

TABLE 5

| Working No. | Summary of Working Method |
|---|---|
| IX | overall heat treated surface (not worked) |
| X | subjecting only upper and lower surfaces of insert to grinding working and providing other part with heat treated surface |
| XI | subjecting only side surfaces of insert to grinding working and providing other part with heat treated surface |
| XII | subjecting insert to only edge treatment shown in FIG. 1 and providing other part with heat treated surface |

In Table 6 are shown the substrate materials of the thus prepared inserts, the working methods after sintering, the heat treatment conditions, the layer thickness of the modified layer present on the heat treated surface, the surface roughness Rmax of the heat treated surface and the working methods after heat treating.

These substrate inserts were subjected to a scratching treatment in an analogous manner to Example 1 and maintained by the known microwave plasma CVD method under conditions of a vibration frequency of 2.45 GHz, insert surface temperature of 870° C. and a total pressure of 50 Torr in an atmosphere of $H_2$—$CH_4$ gas for a period of time of 1 to 15 hours to form diamond-coated layers, thus, obtaining diamond-coated inserts 24) to 51) according to the present invention. Herein, concerning Insert Sample Nos. 50 and 51 of the present invention, the heat treatment process and the process of forming the diamond-coated layer were carried out in a same container, and concerning the diamond-coated Inserts Sample Nos. 52 and 53 of the present invention, after forming the diamond-coated layer, lapping was carried out using a diamond brush until the surface roughness of the diamond-coated layer in the vicinity of the edge and/or on the edge treated surface on the flank face and rake face was an Rmax of 0.5 μm.

In this Example, it was found by Raman spectroscopic analysis that there was present a peak at 1,333 $cm^{-1}$ characteristic of diamond in the coated layer deposited on the surface of the substrate. Rmax* by observation of the cross section after forming the diamond-coated layer is also shown in Table 6.

Furthermore, each of Insert Samples No. 24 to No. 51 whose cross sections had been observed was subjected to measurement of the Vickers hardness of the surface part and interior part of the substrate using a load of 200 g. Thus, it was confirmed that the hardness of the surface part was improved by 5 to 15%.

When the diffraction curve, as to the surface of the heat treated surface, having a diamond-coated layer formed, was measured by Cu-Kα line, in addition, it was confirmed that the foregoing Value A was in the range of 0.05 to 1.0% for the substrate compositions c, d and e. For example, Insert Sample No. 30 of the present invention had a Value A of 0.068. Insert Sample No. 30 of the present invention was subjected to measurement of the residual stress of the WC phase and the lattic constant of the B1 type solid solution of the substrate surface in an analogous manner to Example 1 to obtain at most 0.1 GPa and 4.361 Å.

Using these prepared inserts, a continuous cutting test and intermittent cutting test were carried out ill an analogous manner to Example 1 to obtain results shown in Table 6. In view of the results of Table 6 with those of Table 4, the diamond-coated layer on the heat-treated surface exhibits a high bonding strength similar to the diamond-coated layer on the sintered surface. Even when using an insert with a heat treated surface as a substrate, the resulting insert had a higher toughness as compared with brazed tools of diamond compacts and polycrystalline diamond plates. As a technique of increasing the bonding strength of a diamond-coated layer, as disclosed in Japanese Patent Laid-Open Publication No. 124573/1986, there is proposed a scratching treatment by diamond wheels, but this technique can hardly be applied to a substrate with a three-dimensional complicated shape.

According to the present invention, however, a diamond-coated layer with a high bonding strength can be formed on any substrate with a complicated shape and the present invention has such a large feature that the degree of surface treatment is high. In this Example, estimation of the properties was carried out only in a case where the sintered surface and heat treated surface were not coexistent, but it can surely be presumed that the bonding strength of a diamond-coated layer is not changed even if they are coexistent.

TABLE 6

| Insert Sample No. | Substrate Material | Working of Insert | Heat Treatment Condition | Working of Insert After Heat Treatment | Surface Modified Layer Thickness (μm) | Heat Treated Surface Roughness[8] Rmax | Heat Treated Surface Roughness[8] Rmax* | Removal of Binder Phase[7] | Thickness of Diamond-coated Layer[9] (μm) | Results of Continuous Cutting Test: Cutting Edge State | Results of Continuous Cutting Test: Flank Wear Width (mm) | Results of Intermittent Cutting Test |
|---|---|---|---|---|---|---|---|---|---|---|---|---|
| 24 | a | VIII | i | IX | 1.9 | 1.6 | 2.2 | — | 6.7 | normal wear | 0.15 | 2 |
| 25 | a | VIII | iii | IX | 1.6 | 1.8 | 2.6 | — | 7.1 | normal wear | 0.14 | 2 |
| 26 | b | VIII | i | IX | 4.7 | 1.5 | 2.4 | — | 6.8 | normal wear | 0.14 | 3 |
| 27 | b | VIII | iii | IX | 2.4 | 1.8 | 2.8 | — | 6.5 | normal wear | 0.15 | 2 |
| 28 | c | VIII | i | IX | 12.5 | 2.5 | 3.7 | — | 6.9 | normal wear | 0.08 | 2 |

TABLE 6-continued

| Insert Sample No. | Substrate Material | Working of Insert | Heat Treatment Condition | Working of Insert After Heat Treatment | Surface Modified Layer Thickness (μm) | Heat Treated Surface Roughness[8] Rmax | Rmax* | Removal of Binder Phase[7] | Thickness of Diamond-coated Layer[9] (μm) | Results of Continuous Cutting Test: Cutting Edge State | Flank Wear Width (mm) | Results of Intermittent Cutting Test |
|---|---|---|---|---|---|---|---|---|---|---|---|---|
| 29 | c | VIII | ii | IX | 3.5 | 4.7 | 6.0 | *1 | 6.3 | normal wear | 0.07 | 2 |
| 30 | c | VIII | iii | IX | 3.6 | 6.5 | 8.1 | — | 7.0 | normal wear | 0.06 | 2 |
| 31 | c | VIII | iv | IX | 4.5 | 6.6 | 8.8 | — | 6.6 | normal wear | 0.06 | 1 |
| 32 | c | VIII | v | IX | 5.5 | 6.6 | 9.5 | *1 | 6.5 | normal wear | 0.06 | 0 |
| 33* | c | VIII | vi | IX | no[10] | 1.0 | 1.3 | — | Coated layer was naturally peeled off during cooling. | | | |
| 34 | c | VIII | vii | IX | 1.0 | 1.1 | 1.5 | — | 6.8 | fine peeling | 0.23 | 1 |
| 35 | c | VIII | viii | IX | 2.0 | 1.7 | 2.5 | — | 7.2 | normal wear | 0.18 | 2 |
| 36 | c | VIII | ix | IX | 3.2 | 2.5 | 3.7 | *1 | 7.1 | normal wear | 0.08 | 2 |
| 37 | c | VIII | xx | IX | no | 1.0 | 1.4 | — | Coated layer was naturally peeled off during cooling. | | | |
| 38 | c | VIII | xi | IX | 0.5 | 1.2 | 1.7 | — | 6.7 | fine peeling | 0.22 | 2 |
| 39 | c | VIII | xii | IX | 5.5 | 7.0 | 9.1 | *2 | 6.9 | normal wear | 0.08 | 12 |
| 40*[6] | c | VIII | xiii | IX | 5.0 | 2.7 | 3.5 | *2 | 6.2 | (A) | | 3 |
| 41 | c | VII | iii | X | 3.6 | 6.5 | 8.1 | — | 6.2 | (B) | 0.15 | 4 |
| 42 | c | VII | iii | XI | 3.6 | 6.5 | 8.1 | — | 7.1 | (C) | 0.26 | 4 |
| 43 | c | VII | iii | XII | 3.6 | 6.5 | 8.1 | — | 6.9 | (D) | 0.15 | 3 |
| 44 | c | VIII | iii | IX | 3.6 | 6.5 | 8.1 | — | 0.4 | normal wear | 0.35 | 2 |
| 45 | c | VIII | iii | IX | 3.6 | 6.5 | 8.1 | — | 15.1 | normal wear | 0.05 | 3 |
| 46 | c | VIII | i | IX | 12.5 | 2.5 | 3.0 | *2 | 6.9 | normal wear | 0.11 | 4 |
| 47 | c | VIII | iii | IX | 3.5 | 5.2 | 7.7 | *2 | 6.4 | normal wear | 0.12 | 3 |
| 48 | c | VIII | i | IX | 3.5 | 4.0 | 4.3 | *2 | 6.5 | normal wear | 0.19 | 5 |
| 49 | c | VIII | iii | IX | 2.5 | 1.3 | 1.6 | *2 | 6.5 | normal wear | 0.17 | 4 |
| 50 | c | VIII | i | IX | 12.4 | — | 3.8 | — | 7.5 | normal wear | 0.07 | 2 |
| 51 | c | VIII | iii | IX | 3.6 | — | 8.0 | — | 7.0 | normal wear | 0.07 | 3 |
| 52 | c | VII | iii | IX | 3.6 | 5.3 | 7.5 | — | 15.2 | normal wear | 0.04 | 4 |
| 53 | c | VIII | iii | IX | 3.7 | 5.5 | 7.7 | — | 14.7 | normal wear | 0.05 | 2 |

Note:
Cutting Edge State
(A): At cutting for 2 minutes, flank wear width exceeded 3.0 mm. (B): fine peeling on rake face; (C): fine peeling on flank face; (D): fine peeling on NL face;

In Table 6, note marks have the following meanings:

6) The surface-modified layer of Insert Sample No. 40* is a different surface-modified layer from that of the present invention, in which the binder phase content is higher than in the interior part and the presence proportion of the hard phase components such as TiC, TaC, etc. is decreased in the similar manner to Insert Sample No. 9* in Table 4 (Comparative Example). Results of the continuous cutting test of Insert Sample No. 40* were similar to those of Comparative Example C of Table 4.

7) The contents * 1 and * 2 in Method of Removing Binder Phase are the same as those in Table 4.

8) Rmax and Rmax* of the ground surface were 1.0 μm.

9) The layer thickness of the diamond-coated layer is a mean layer thickness in the vicinity of the edge of the insert.

10) "Surface-modified Layer no" means a state of less than the critical point capable of observing a cross section by an optical microscope.

[EXAMPLE 3]

Powders of Compositions f to k shown in the following Table 7 were prepared as a raw material powder.

TABLE 7

| | Composition of Substrate (weight %) |
|---|---|
| Composition f | tungsten carbide (WC) |
| Composition g | WC - 0.5 wt % Co |
| Composition h | WC - 4 wt % Co |
| Composition i | WC - 5 wt % Co - 0.5 wt % TaC - 0.5 wt % NbC |
| Composition j | WC - 10 wt % Co - 10 wt % TiC - 11 wt % TaC |
| Composition k | tungsten (W) |

The powders having the compositions as shown in Table 7 were combined and and according to the methods illustrated in the specification, substrates of tungsten-based cemented carbides having surface-modified layers shown in Table 8 were respectively prepared. The sintering conditions were an atmosphere of $N_2$ gas, temperature of 1350° C., pressure of 1000 atm and a period of time of 1 hour for Composition j and an atmosphere of Ar gas, temperature of 1350° C., pressure of 5 atm and a period of time of 1 hour for other Compositions. The shape of the substrate is a throwaway shape of SEGN 422 described in JIS B 4103, i.e. inscribed circle 12.7 mm, thickness 3.18 mm, corner R 0.8 mm and angle of relief 20°.

Each of the thus prepared substrates was added to ethyl alcohol with diamond grains with grain diameters of 8 to 16 μm, to which supersonic wave vibration was applied for 15 minutes to effect a scratching treatment thereof. Then, the substrate was charged in a μ wave plasma CVD apparatus of 2.45 GHz, heated at 900° C. and maintained in a mixed plasma of hydrogen-2% methane with a total pressure of 80 Torr for 1.5 to 30 hours to form a layer thickness of 2 to 40 μm. Thus, diamond-coated Cutting Inserts Nos. 54 to 62 of the present invention, shown in Table 8 were prepared.

For comparison, substrates of tungsten-based cemented carbides having the same throwaway shape as described above and overall homogeneous compositions (having no surface-modified layer) were respectively prepared by the ordinary sintering method. Each of the substrates was not subjected to the scratching treatment by supersonic wave vibration and the diamond-coated layer was formed in the similar manner to described above, thus preparing comparative diamond-coated Cutting Inserts Nos. 63 to 65.

As to the diamond-coated layers of Insert Sample Nos. 54 to 65 of Examples of the present invention and Comparative Examples, the presence of a peak at 1333 $cm^{-1}$ characteristic of diamond was confirmed by Raman spectroscopic analysis.

TABLE 8

| Insert Sample No. | Preparation Method | Substrate Composition | Surface-Modified Layer Composition | Surface-Modified Layer Thickness (μm) | Diamond-Coated Layer Thickness (μm) |
|---|---|---|---|---|---|
| 54 | A | h | f | 20 | 10 |
| 55 | A | i-g | f | 30 | 8 |
| 56 | A | j | f | 15 | 6 |
| 57 | A | j | g | 50 | 20 |
| 58 | B | i | f | 80 | 40 |
| 59 | B | j | g | 200 | 2 |
| 60 | C | h | f | 100 | 6 |
| 61 | C | h | k | 15 | 12 |
| 62 | D | j | f | 25 | 10 |
| 63 | ordinary method | h | no | 0 | 10 |
| 64 | ordinary method | i | no | 0 | 8 |
| 65 | ordinary method | j | no | 0 | 15 |

Note:
In Insert Sample No. 55, the Substrate Composition i-g is stepwise varied in such a manner that the interior part has Composition i and the surface-modified layer side has Composition g. In Insert Sample No. 62, the surface-modified layer consists of W (k) mixed with WC to some extent.

Using these diamond-coated cutting inserts, Sample Nos. 54–65, intermittent cutting tests were carried out under the following conditions.

| | |
|---|---|
| Workpiece to be cut: | Al-18 wt % Si alloy (block material) |
| Cutting Speed: | 700 m/min |
| Feed: | 0.3 mm/rev |
| Cutting Depth: | 2.0 mm |

When the flank wear width was measured after 20 minutes as to Insert Sample Nos. 54 to 62 of the present invention and after 1 minute as to Insert Sample Nos. 63 to 65 for comparison and the wear states of the edges were observed, there were obtained results as shown in Table 9.

TABLE 9

| Insert Sample No. | Flank Wear Width (mm) | State of Cutting Edge |
|---|---|---|
| 54 | 0.08 | normal wear |
| 55 | 0.06 | normal wear |
| 56 | 0.09 | normal wear |
| 57 | 0.11 | fine peeling |
| 58 | 0.09 | normal wear |
| 59 | 0.13 | fine peeling |
| 60 | 0.09 | normal wear |
| 61 | 0.12 | normal wear |
| 62 | 0.06 | normal wear |
| 63* | 0.24 | normal wear |
| 64* | 0.30 | normal wear |
| 65* | 0.28 | normal wear |

Note:
*Comparative Example

It will clearly be understood from the above described test results that Insert Sample Nos. 54 to 62 are favorably compared with Insert Sample Nos. 63 to 65 for comparison as to the bonding strength of the diamond-coated layer and the wear resistance as a cutting tool and in addition, Insert Sample Nos. 54, 56, 58, 60 and 62 containing no binder phase in the the surface-modified layers of Examples of the present invention exhibit no occurrence of even fine scaling on the cutting edges and particular excellent bonding strengths of the diamond-coated layers.

[EXAMPLE 4]

Application of the diamond-coated hard material of the present invention to drills is shown in this Example. As a substrate (overall grpund surfcae), there was used a cemented carbide drill having a diameter of 8 mm, a twist drill shape of JIS 4301 and a composition of WC-9 weight % Ti-6 weight % TaC-3 weight % NbC-7 weight % Co. This drill was subjected to ① a heat treatment in an $N_2$ atmosphere at 1350° C. and 100 Torr for 60 minutes to obtain a drill ① of the drill substrate of the present invention, ② a heat treatment in a CO atmosphere at 1350° C. and 100 Torr for 60 minutes to obtain a drill ② of the drill substrate of the present invention and ③ a heat treatment in an $N_2$ atmosphere at 1300° C. and 100 atm for 60 minutes to obtain a drill ③ of the drill substrate of the present invention, and using the known microwave plasma CVD method in an anlogous manner to Example 2, a diamond-coated layer of about 4 μm was formed on each of the substrates to prepare drills ① to ③ of the present invention formed in a depth of 30 mm from the drill end toward the shank. Furthermore, the surface of the drill ③ of the present invention was partly ground to an Rmax of 0.2 μm by the use of a diamond wheel and diamond brush to prepare a drill ④ of the present invention.

For comparison, the drill before the heat treatment was used as a comparative drill ⑤ and a similar diamond-coated layer was formed on the heat-treatment-free drill to prepare a comparative drill ⑤.

Using these drills, drilling working was carried out to the end of the service life thereof under the following conditions:

| | |
|---|---|
| Workpiece to be cut: | Al-21 wt % Si alloy |
| Cutting Speed: | 100 m/min |

-continued

| | |
|---|---|
| Feed: | 0.24 mm/rev |
| Cutting Depth: | 50 mm |
| Cutting Oil: | water-soluble |
| Judgment of Life: | Time when flank wear width of outer circumference reaches 0.1 mm or when sample is broken. |

Test results are shown in the following Table 10.

TABLE 10

| Drill No. | Number of Drilled Holes | Wear state of Edge |
|---|---|---|
| ① | 1420 | normal wear |
| ② | 1612 | normal wear |
| ③ | 1548 | normal wear |
| ④ | 2196 | normal wear |
| ⑤ | 189 | much welding of workpiece |
| ⑥ | 247 | large peeling of diamond coated layer |

It will be understood from the results of Table 10 that the drill of the present invention has a very high bonding strength between the diamond-coated layer and substrate and grinding of the surface results in reduction of occurrence of burr and improvement of the quality of drilled holes, so that the service life of the drill be lengthened.

According to the present invention, it is thus possible to form a diamond-coated layer strongly bonded even to a substrate having a three-dimensional shape which has hardly been subjected to mass production by a brazing method of the prior art. Moreover, it can readily be assumed that the present invention can be applied to endmills, etc.

[EXAMPLE 5]

Application of the diamond-coated hard material of the present invention to wear resistant tools such as thrusting pin as a tool for mounting an electronic part is shown in this Example. Using a substrate having the same composition as that of Example 3, a thrusting pin having a diameter of 0.6 mm, total length of 10 mm and an end R of 30 μm was prepared, which was then subjected to a heat treatment in an $N_2$ atmosphere at 1300° C. and 100 atm for 60 minutes. A diamond-coated layer with a thickness of 3 μm was formed on the surface in an analogous manner to Example 2. For comparison, a comparative pin of natural diamond having the same shape and a comparative pin of cemented carbide having a diamond-coated layer formed on the heat treatment-free surface were prepared.

These samples were subjected to a wear resistance test for thrusting up electronic parts (2 mm×3 mm×0.3 mmt) conveyed by an adhesive tape of 80 to 90 μm in thickness with a thrusting load of 40 to 50 g and a thrusting quantity of 1.4 mm. The service life of this pin was defined by a time when the pin could not thrust up the adhesive tape. The life of each of the sample pins is shown in Table 11.

TABLE 11

| Pin | Number of Thrusting Up Until Service Life | State of Wearing |
|---|---|---|
| Pin of Present Invention | $116 \times 10^4$ | normal wearing |
| Pin of Natural Diamond | $121 \times 10^4$ | normal wearing |
| Pin of Cemented Carbide | $10 \times 10^4$ | normal wearing |
| Pin of Diamond-Coated | $25 \times 10^4$ | large peeling of |

TABLE 11-continued

| Pin | Number of Thrusting Up Until Service Life | State of Wearing |
|---|---|---|
| Cemented Carbide | | diamond-coated layer |

It will be understood from the results of Table 11 that the pin of the present invention has substantially the same life as the pin of natural pin.

It can readily be assumed that good results can be obtained even when the present invention is applied to wear resistant tools such as TAB tools and routers and other various mechanical parts.

Utility and Possibility on Commercial Scale

Accordingly, it is apparent from the above described illustration that the diamond-coated hard material of the present invention can favorably compared with the diamond-coated hard material of the prior art in peeling or scaling resistance of the diamond film and has a comparable wear resistance to natural diamond, diamond compacts and polycrystalline diamond as well as a high strength. Furthermore, the diamond-coated hard material of the present invention can exhibit a higher degree of shaping and can be produced in a more economical manner and in a larger quanity, as compared with the case of using natural diamond, diamond compacts and polycrystalline diamond.

The foregoing illustrations of embodiments of the present invention are limited to cutting tools and wear resistant tools, but it is obvious to those skilled in the art that good results will be obtained when the present invention is applied to other various cutting tools, wear resistant tools, various mechanical parts, grinding wheels, etc.

We claim:

1. A diamond-coated hard material comprising a substrate of a tungsten carbide-based cemented carbide containing a hard phase consisting of tungsten carbide, or a hard phase consisting of a solid solution of tungsten carbide and at least one of carbides, nitrides and carbonitrides of Group 4B, 5B and 6B elements, exclusive of tungsten, of the Periodic Table, a binder phase, and unavoidable impurities; a surface-modified layer formed on the surface of the substrate; and a diamond- or diamond-like carbon-coated layer, wherein the surface-modified layer consists of binder phase-free tungsten and/or tungsten carbide, or a binder phase-containing tungsten and/or tungsten carbide in which the proportion of binder phase is less than in the interior part of the substrate.

2. A diamond-coated hard material comprising a substrate of a tungsten carbide-based cemented carbide having a diamond-coated layer provided on the surface of the substrate, in which a hard phase exists on the surface of the substrate in a proportion larger than that in the interior part of the substrate, the hard phase being composed of (1) WC and/or (2) at least one solid solution of WC and at least one of carbides, nitrides, carbonitrides, oxides, borides, borocarbides, boronitrides and borocarbonitrides of Group 4B, 5B and 6B elements, exclusive of W, of the Periodic Table and/or (3) at least one of carbides, nitrides, carbonitrides, oxides, borides, borocarbides, boronitrides and borocarbonitrides of Group 4B, 5B and 6B elements, exclusive of W, of the Periodic Table or at least one solid solution of at least two of these compounds.

3. A diamond-coated hard material comprising a substrate of a tungsten carbide-based cemented carbide having a diamond-coated layer provided on the surface of the substrate, in which a surface-modified layer is present on the outermost surface of the substrate and the surface-modified layer contains no binder phase or contains a binder phase in a proportion of less than in the interior part of the substrate, and the surface-modified layer has a hard phase composed of (1) WC and/or (2) at least one solid solution of WC and at least one of carbides, nitrides, carbonitrides, oxides, borides, borocarbides, boronitrides and borocarbonitrides of Group 4B, 5B and 6B elements, exclusive of W, of the Periodic Table and/or (3) at least one of carbides, nitrides, carbonitrides, oxides, borides, borocarbides, boronitrides and borocarbonitrides of Group 4B, 5B and 6B elements, exclusive of W, of the Periodic Table or at least one solid solution of at least two of these compounds and (4) unavoidable impurities.

4. The diamond-coated hard material as claimed in any of claims 1 to 3 or 6, wherein the material of the substrate is a WC-based cemented carbide comprising a hard phase consisting of (1) WC and/or (2) at least one solid solution of WC and at least one of carbides, nitrides, carbonitrides, oxides, borides, borocarbides, boronitrides and borocarbonitrides of Group 4B, 5B and 6B elements, exclusive of W, of the Periodic Table and/or (3) at least one of carbides, nitrides, carbonitrides, oxides, borides, borocarbides, boronitrides and borocarbonitrides of Group 4B, 5B and 6B elements, exclusive of W, of the Periodic Table or at least one solid solution of at least two of these compounds, (4) a binder phase consisting of an iron group metal and (5) unavoidable impurities.

5. The diamond-coated hard material as claimed in any of claims 1 to 3, wherein the surface-modified layer has a thickness of 0.01 to 200 μm.

6. A diamond-coated hard material comprising a substrate of a tungsten carbide-based cemented carbide having a diamond-coated layer provided on the surface of the substrate, in which at least a part of the surface of the substrate is a sintered surface and the diamond-coated layer is formed on at least part of the sintered surface.

7. The diamond-coated hard material as claimed in any of claims 1 to 3, or 6 wherein at least a part of the surface of the substrate is a sintered surface and the diamond-coated layer is formed on at least part of the sintered surface, from the surface of which the binder phase has been removed.

8. A diamond-coated hard material comprising a substrate of a tungsten carbide-based cemented carbide having a diamond-coated layer provided on the surface of the substrate, in which the substrate is worked in an arbitrary shape and subjected to a heat treatment to convert at least a part of the substrate surface into a heat treated surface, and the diamond-coated layer is formed on at least a part or whole of the surface of the substrate.

9. The diamond-coated hard material as claimed in any of claims 1 to 3, or 6 wherein the substrate is worked in an arbitrary shape and subjected to a heat treatment to convert at least a part of the substrate surface into a heat treated surface, and the diamond-coated layer is formed on at least a part or whole of the heat treated surface, from the surface of which the binder phase has been removed.

10. The diamond-coated hard material as claimed in any of claims 1 to 3, or 6 wherein the surface roughness of the substrate surface to be coated with a diamond-coated layer is represented by an Rmax of at least 1.5 μm.

11. The diamond-coated hard material as claimed in any of claims 1 to 3, or 6 wherein in the substrate, the binder phase is substantially continuously or stepwise decreased from the interior part toward the surface.

12. The diamond-coated hard material as claimed in any of claims 1 to 3, or 6 wherein in the substrate, the hard phase has a grain diameter of at least 1 μm.

13. The diamond-coated hard material as claimed in any of claims 1 to 3, or 6 wherein the diamond-coated layer has 8 layer thickness of 0.5 to 300 μm.

14. The diamond-coated hard material as claimed in any of claims 1 to 3, or 6 wherein the surface roughness of the diamond-coated layer is represented by Rmax of at most 0.5 μm.

15. The diamond-coated hard material as claimed in any of claims 1 to 3, or 6 wherein the hardness of the surface part of the substrate, by Vickers hardness, is higher by at least 5% than that of the interior part thereof.

16. The diamond-coated hard material as claimed in any of claims 1 to 3, or 6 wherein in the diffraction curve by Cu-Aα line from the surface of the diamond-coated layer, the diffraction intensity ratio of (101) plane of tungsten carbide is smaller than that of (200) plane of the B1 solid solution of at least one of carbides, nitrides, carbonitrides, oxides, borides, borocarbides, boronitrides and borocarbonitrides of Group 4B, 5B and 6B elements exclusive of W of the Periodic Table.

* * * * *